United States Patent [19]

O'Nion et al.

[11] Patent Number: 4,876,978

[45] Date of Patent: Oct. 31, 1989

[54] COUPLING BETWEEN TWO PARTS WHICH ARE MOVABLE WITH RESPECT TO EACH OTHER

[75] Inventors: Geoffery O'Nion, Monte Carlo, Monaco; Jean C. Gramet, Beaulieu, France

[73] Assignee: Single Buoy Moorings Inc., Marly, Switzerland

[21] Appl. No.: 217,225

[22] Filed: Jul. 11, 1988

[30] Foreign Application Priority Data

Jul. 10, 1987 [NL] Netherlands ..... 8701637

[51] Int. Cl.[4] ..... B64G 1/64

[52] U.S. Cl. ..... 114/230

[58] Field of Search ..... 114/221 R, 230, 249, 114/250, 252; 441/3-5; 244/161, 135 A

[56] References Cited

U.S. PATENT DOCUMENTS

| | | | |
|---|---|---|---|
| 2,692,102 | 10/1954 | Cobham et al. | 244/135 |
| 4,236,686 | 12/1980 | Barthelme et al. | 244/135 A |
| 4,372,344 | 2/1983 | Stafford | 441/5 |
| 4,588,150 | 5/1986 | Bock et al. | 244/161 |

FOREIGN PATENT DOCUMENTS

| | | |
|---|---|---|
| 1278866 | 12/1964 | Fed. Rep. of Germany . |
| 7711309 | 4/1978 | Netherlands . |

*Primary Examiner*—Sherman D. Basinger
*Assistant Examiner*—Edwin L. Swinehart
*Attorney, Agent, or Firm*—Young & Thompson

[57] ABSTRACT

Coupling between a vessel (1) and a mooring device (12) comprising a pin and a receiving sleeve (14) into which the pin (9) may slide axially, the sleeve (14) being swingably suspended and connected with hydraulic struts (18) in a circuit with valves (28,29) which can block the movability of the struts (18).

5 Claims, 5 Drawing Sheets

COUPLING BETWEEN TWO PARTS WHICH ARE MOVABLE WITH RESPECT TO EACH OTHER

The invention relates to the coupling of two devices which are free to move with respect to each other for performing a connection between them. Such a coupling is useful between a vessel and a mooring device, of which devices at least one is free to move under the action of external forces, such as due to waves, wind and current, which coupling comprises a guide pin which has been pivotable suspended from one device, as well as a receiving guide unit in the other device for receiving the pin.

From the published Dutch patent application No. 8100936 it is known to use a quick disconnection between a tanker and a mooring device, allowing to break the connection between tanker and mooring device in case this becomes necessary e.g. due to weather circumstances.

The broken connection has to be re-established. One possibility for performing said connection has been described in the OTC-Report 5490, 1987, in the article "Disconnectable Riser Turret Mooring System for Jabiru's Tanker-Based Floating Production System" by A. J. Mace and K. C. Hunter. According to said known manner for performing the connection a freely swingable pin has been suspended by means of a universal joint from the tanker, which pin has to be guided from the tanker into a receiving unit in the mooring device, which in the case described in said article is formed by a cylindrical buoy. To facilitate said operation a cable runs through the receiving unit and through the pin which cable prior to performing the connection has to be lifted and guided through the pin. Furthermore a receiving unit guiding ring has been provided. After performing said coupling the real force transmitting connection has to be made as well as conduit connections.

During performing the coupling between tanker and mooring device each perform movements independent from each other which are caused by outer circumstances, such as waves, wind, current etc. Tanker and mooring device each represent a large mass.

During and after coupling, the coupling pin and receiving unit have to take up large forces. Accordingly they also have relatively large masses. During the approach of pin and receiving unit with or without the aid of the guiding cable, problems occur resulting from the non synchronizable arbitrary movements with respect to each other of tanker and mooring device. These are amongst others relative vertical movements, relative horizontal movements and different angular positions between the axis of pin and receiving unit. The collision forces which due to this occur and cannot be avoided, have amongst others as consequence that pin and receiving unit have to be designed very strong. In the known proposal the receiving unit is funnel-shaped to cope with the changing angular positions. A funnel, however, is not a good guide.

Purpose of the invention is to provide a coupling which in performing a connection between a vessel and a mooring device no longer has the disadvantages of the known coupling and which in general is suitable as well for performing a connection between devices which move with respect to each other, including a connection between a vessel and a rigidly positioned device. Large collision forces should be avoided.

According to the invention this purpose in the first place is achieved in that the receiving unit comprises a sleeve adapted to receive the pin and let it slide along its axis, which sleeve is swingably suspended in the other device about at least two perpendicular axes and at a distance from the suspension is connected with at least three struts with hydraulic cylinders arranged around the axis of the sleeve which struts find support upon the other device. With the receiving unit according to the invention the pin now, with or without making use of a guiding cable, can be guided into the sleeve with the sleeve immediately moving in line according to the axis of the pin acting as guiding pin, which lining up is assisted in case a guiding cable is applied which in that case runs through the sleeve. This lining up of sleeve and pin is possible by the swingable suspension of the sleeve which sleeve in the beginning is not affected with respect to its freedom of movement by the struts. Once the pin has been sufficiently introduced into the sleeve the mode of operation of the struts is changed, by closing valves in the hydraulic circuit of the cylinders of the struts.

The moment in time to effect the change in mode of operation of the struts is irrespective of the existing relative motions of the devices existing at that moment. If the mode of operation of the struts occurs at a time of maximum relative velocity of the two devices, the imposed forces between the pin and sleeve would be greater than that load necessary to shorten the struts; consequently the loaded struts will shorten allowing a motion of the sleeve.

The relative motions of the two devices are periodic therefore at a given movement when the relative velocity of the two devices becomes zero the loading between the two devices will only be those loads which are existing externally such as waves, wind, current, etc. the load necessary to effect a shortening of said struts will be larger than those loads imposed externally, subsequently the two devices are blocked relative to each other. With the transverse motions of the two devices effectively blocked, the pin is free to move axially within the blocked sleeve allowing for a further coupling to be completed to arrest the relative axial motions of the two devices and subsequently the connection can be made.

According to the invention each of the struts connecting the swingable sleeve to the device supporting the sleeve preferably comprises at least two cylinder piston units joined in series. The first of said cylinder piston units on each strut is connected to each similar cylinder piston unit on each of the other struts by a hydraulic circuit having shut-off valves. The hydraulic circuit connecting the said cylinders having the shut-off valves open allow the flow of liquid from one unit into other or others which guarantees in the beginning of performing the coupling the free movability of the sleeve. With the shut-off valves of the said hydraulic circuit in the closed position each said cylinder piston unit will work independently drawing fluid from a reservoir to freely extend but being blocked against shortening by fluid from said units being unable to pass a uni-directional valve in the hydraulic circuit.

The second cylinder piston unit or units connected in series with the said first cylinder piston unit to form the said strut is or are connected to a hydraulic circuit which is couled with an accumulator. Incorporated in the hydraulic circuit will be a non-return valve which allows fluid to leave said cylinder piston unit or units against the action of the accumulator but does not allow return of fluid into the said cylinder piston unit or units.

One can achieve the function of the second said cylinder piston units, coupled to an accumulator, by replacing them with units which pertain to constant load with displacement units as exhibited by non-viscous shock absorbers.

According to the invention the said struts comprising of the said first and second cylinder piston units are free to extend and shorten with the shut-off valves of the first said hydraulic circuit being in the open position and with the said shut-off valves closed the struts can freely extend but can shorten only under the action of a compressive load greater than that imposed by the accumulator pressure acting on the second said cylinder piston units.

Preferably the cylinders of the second units of each strut have a total piston cross sectional area less than that of the cylinders of the first unit.

After performing the coupling and prior to making the final connection, the sleeve with the pin in it has to be returned towards the central position because in general the sleeve at the end of the coupling with blocked first units will be in an inclined position whilst for at least one of the second units a displacement did take place against the pressure of the accumulator.

By connecting the accumulator with the first units one achieves that said units return the sleeve to the central position. The first cylinder units become completely extended and the second cylinder units become completely contracted, the geometry being such that the sleeve is centralized.

The purpose of the struts is to arrest and eventually block the movements of the sleeve by restraining the sleeve transversely to the axis of the sleeve at a distance from the pivotable suspension. To locate the axis of said struts transverse to the axis of the sleeve requires a considerable amount of space. The invention to this end provides that the struts placed between sleeve and other device are at a sharp angle with the axis of the sleeve. With said inclined positioning a considerable saving in space is obtained, albeit at the cost of a somewhat favourable load.

A further saving in space and excellent distribution of forces can be obtained in case the cylinders of the first and second units are arranged around each other.

The pivotable suspension of the sleeve can comprise a ball joint, e.g. in the form of spherical discs resting one in the other. The joint, however, can also comprise an elastomer, e.g. in the form of a layer between two concentric spherical discs.

The invention now wil be further elucidated with reference to the drawings.

Figure 2:
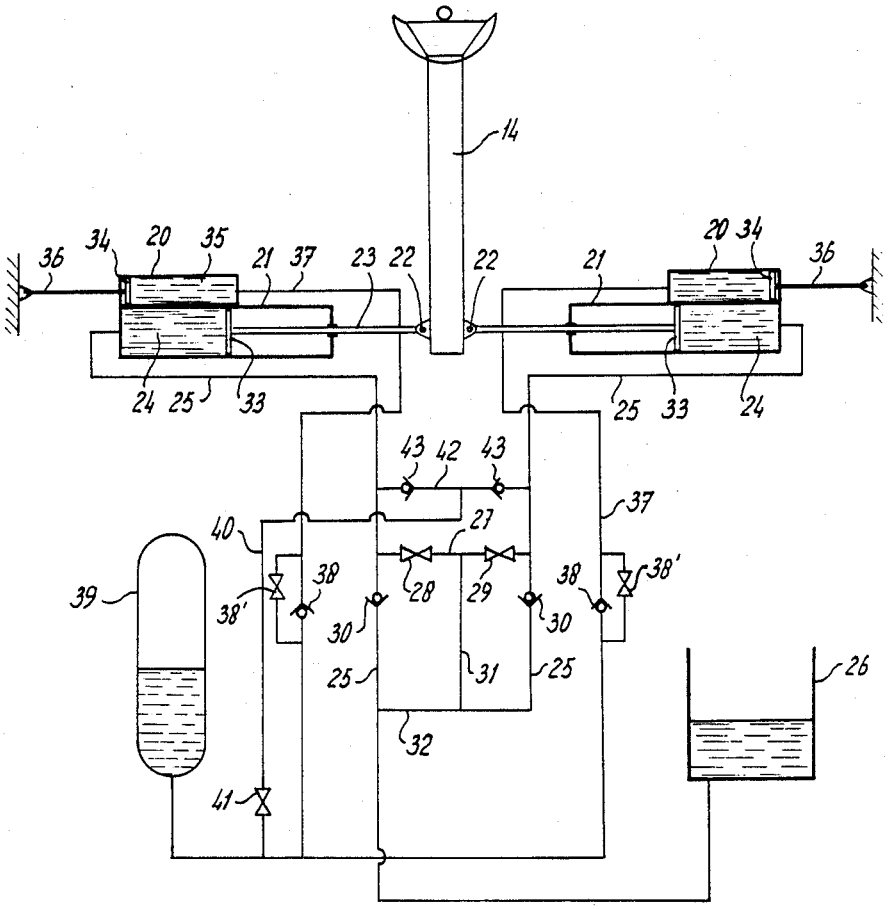
FIG. 2 shows an operation scheme.
Figure 2A:
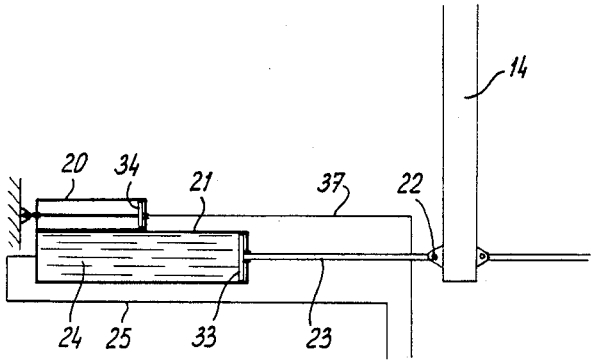

FIG. 2*a* shows part of the operation scheme of FIG. 2 in a different position.

Figure 3:
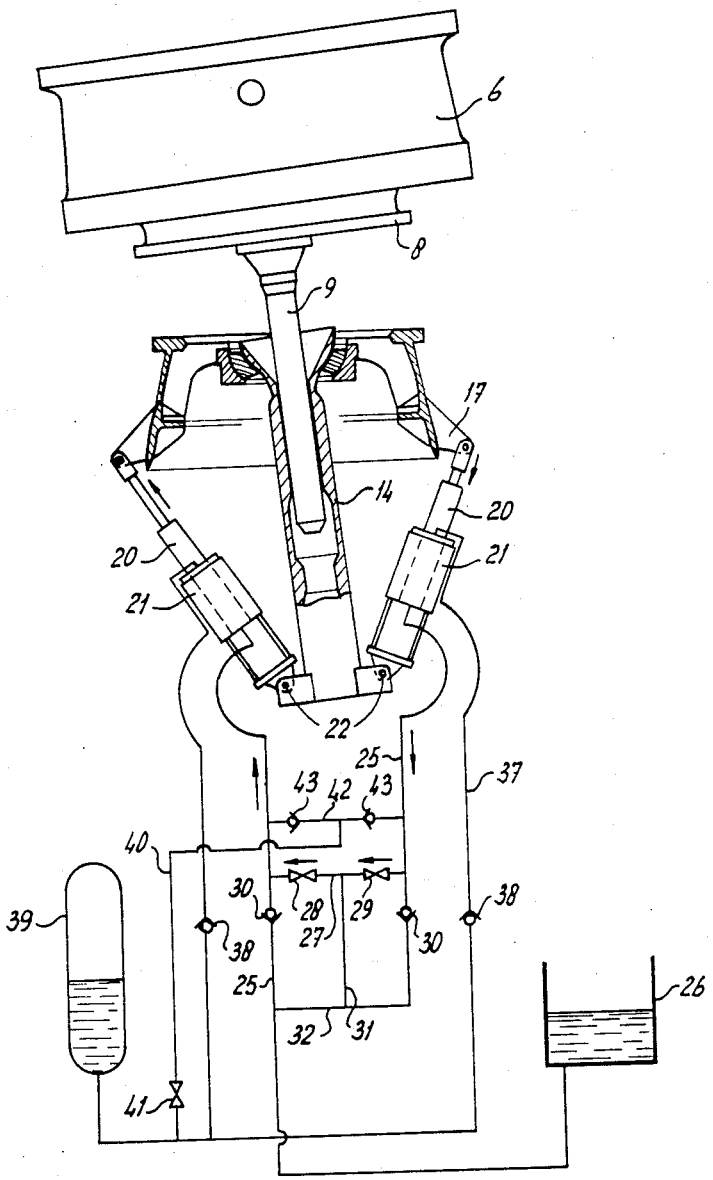

FIG. 3 shows in side view diagrammatically one embodiment.

Figure 4:
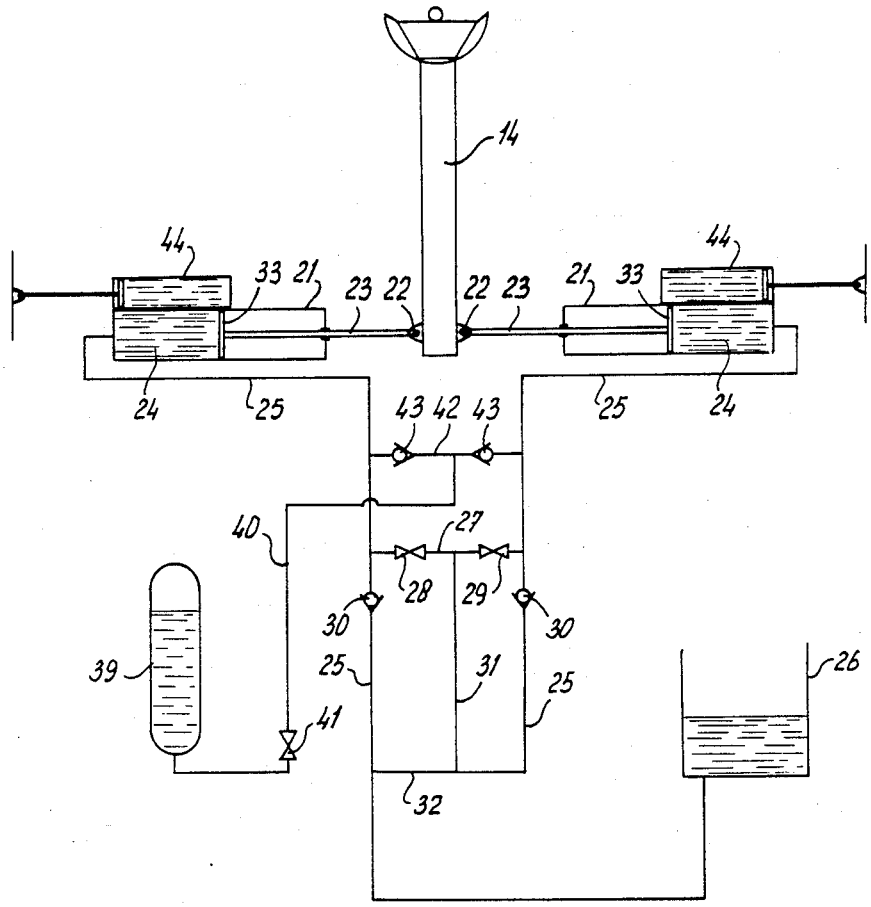

FIG. 4 is an alternative to FIG. 2.

Figure 1:
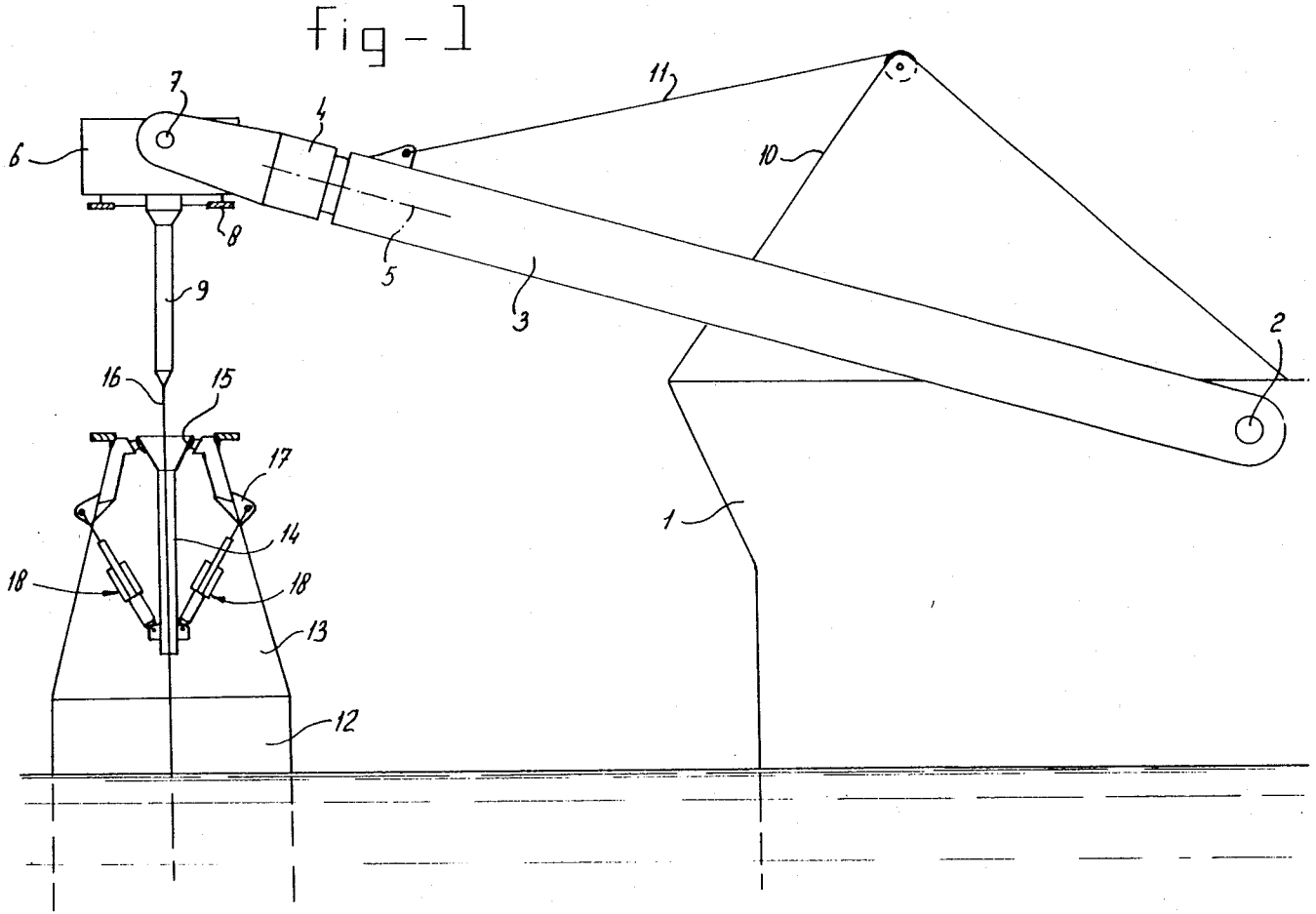
FIG. 1 is a diagrammatic side view of a possible coupling according to the invention.

FIG. 1 shows diagrammatically a tanker or ship 1 provided with a mooring arm or yoke 3 pivotably connected to the bow 2. This yoke has an outer end 4 which is rotatable about the axis 5 and at its outer end carries a ring 6, which is pivotable about a horizontal axis 7 which extends perpendicular to the axis 5.

A crown 8 is rotatably supported in the ring 6 which crown carries the pin 9.

The yoke 3 can be moved upwardly and downwardly with the aid of diagrammatically shown lifting means 10, 11.

At 12 is shown the upper end of a column floating in the water which column in a manner not shown is moored at the lower end by means of anchor chains. However, this also can be a rigid column or a column the lower end of which is pivotably connected to a bottom anchor.

A sleeve 14 is suspended at 15 with the aid of a joint allowing perpendicular movements about two horizontal perpendicular axes in the upper part 13 of said column. A guiding cable 16 extends through said sleeve 14 which cable for performing the coupling is guided through the pin 9 and in a manner not shown runs over a guiding roller towards a winch placed on the deck of the vessel 1. This cable also has low stiffness. It has to guide the pin into the sleeve.

Between the lower end of the sleeve 14 and brackets 17 of the upper part of the column, struts 18 having cylinder units are provided which are placed at a sharp angle with the axis of the sleeve 14.

FIG. 3 shows pin 9 and sleeve 14 more in detail and in a position with the pin already moved substantially into the sleeve 14.

The cylinder units comprise an inner cylinder 20 and concentrically around it an outer cylinder 21, both connected with a hydraulic circuit which will be described further with reference to FIG. 2.

FIG. 3 shows that the sleeve 14 takes a position which corresponds with the existing position of the pin during insertion of the pin into the sleeve.

FIG. 2 shows the sleeve 14, the lower end of which at 22 is coupled with the piston rods 23 of first hydraulic cylinder-piston units 21. There are at least three regularly distributed around the sleeve 14. FIG. 2 shows two in one plane with an embodiment which has been provided with four cylinder units.

In the diagram of FIG. 2 the first cylinder units 21 and the second cylinder units 20 are placed around each other with the housings of the cylinders 20 and 21 forming a rigid unit.

The oil filled cylinder spaces 24 of the first units 21 by means of the conduits 25 are in connection with a supply reservoir 26. Between said conduits there is a connecting conduit 27 with valves 28 and 29 respectively.

The conduits 25 moreover are provided with non-return valves 30, which allow flow of liquid from the reservoir into the units but not the reverse.

If the valves 28 and 29 are open then liquid can flow from one cylinder space 24 through 25, 27 and 25 into the opposite cylinder space 24. Possible liquid deficiency can be supplied from the reservoir 26 through the conduits 31 and 32.

If the valves 28 and 29 are closed the pistons 33 are blocked in the cylinders 21 in the position which exists at that moment, which as a rule will be an inclined position, as shown in FIG. 3.

As the movements of the masses to be coupled with each other continue, this means that at the moment of blocking, large forces occur which have to be taken up.

In the diagram of FIG. 2 the second cylinder units 20 serve that purpose.

With said cylinder units 20 the pistons 34 are in their outer position, which means that the cylinder spaces 35 are completely filled with liquid. The pistons through rods 36 are connected with the upper end of the column within which the sleeve 14 is swingably supported.

The liquid spaces 35 are connected with a pressure accumulator 39.

The forces which occur after blocking of the cylinder units 21, now are taken up by the second units 20 acting as buffer in that at the second unit at that side at which a large force has to be taken up, the piston 34 will penetrate into cylinder 20 and displace liquid from the space 35 through conduit 37 and non-return valve 38 towards the accumulator 39, which allows the motion to continue and naturally stop while the load exerted by the second unit 20 increases as the pressure in the accumulator increases.

The entire structure thereafter will be at rest in the sense that at the location of the coupling no relative movements except those parallel to the axis of pin and sleeve take place any more, in which position, however, the sleeve may be in an undesirable inclined position as e.g. shown in FIG. 3. A return towards the central position is desirable prior to making the final connection. To this end the circuit has a conduit 40 with valve 41 having a connection with the conduits 25 towards the liquid spaces 24 of the first units, in which connecting conduit 42 non return valves 43 are provided.

If after performing the coupling the valve 41 is opened then the accumulator will feed liquid through the conduit 40 and 42 and non-return valves 43 and conduits 25 into the liquid spaces 24 of the first units 21. As the housings of the first and second units form a unit with each other and the cylinders 21 with this embodiment have a larger diameter than the cylinders 20, and as all cylinders 20 and 21 are subjected to the same liquid pressure from the accumulator 39, the piston rods 23 of the first units 21 will extend and the piston rods 36 of the second units 20 will retract such as the end position in Figure 2a is obtained. There upon the sleeve 14 returns in the central position. Liquid return towards cylinder 20 can take place by putting the non-return valve 38 out of operation or by short circuiting said valve as shown at 38'. Therewith the system can be reset into its original position.

FIG. 4 shows a number of simplifications and in said figure those parts which are present in FIG. 2 have the same reference numerals.

In the embodiment diagrammatically shown in FIG. 4 only first hydraulic cylinder piston units are present indicated with reference 21, the liquid spaces of which, through conduits 25 and valves 28, 29 in conduit 27, are interconnected with each other and with the reservoir 26. Closing of the valves 28 and 29 effects blocking of the pistons 33 in the cylinders 21.

The piston 33 can still move in cylinders 21, fluid being displaced through conduits 25 and non return valves 30.

The cylinders 20 of FIG. 2 have been replaced in FIG. 4 by shock absorbers 44.

After performing the coupling the valve 41 is opened then the accumulator 39 will feed liquid through conduits 40 and 42, and non-return valves 43 to fully extend piston 33 in cylinder 21 and fully compressing shock absorbers 44 centralizing the sleeve 14.

We claim:

1. Coupling for performing a connection between a vessel and a mooring device, comprising a pin pivotably suspended from one of said vessel and mooring device as well as a receiving unit on the other of said vessel and mooring device with guide means for receiving the pin to perform said connection between said vessel and said mooring device; the improvement wherein the receiving unit is a substantially vertical sleeve which is swingably suspended about at least two perpendicular axes, which sleeve below its place of suspension is connected to at least two lockable struts distributed about the axis of the sleeve and adapted to allow or block respectively the swinging movements of the sleeve, said struts comprising cylinder-piston units having liquid spaces mutually connected by a hydraulic circuit having shut-off valves, which valves in their open position allow the flow of liquid from one said unit into at least one other said unit to allow free swinging movement of the said sleeve and which in the closed position block the pistons within their respective cylinders, said struts being connected with the body supporting the sleeve through the intermediation of a buffer.

2. Coupling as claimed in claim 1, wherein each buffer between the said strut and the said body comprises a second hydraulic cylinder-piston unit having a cylinder housing with a liquid filled cylinder space which is rigidly connected to a cylinder housing of the first mentioned cylinder-piston unit of the strut, a piston rod of one of said first mentioned cylinder-piston units being connected to the sleeve and a piston rod of the second cylinder piston unit being connected to the body, the liquid filled cylinder space of each said second unit being connected to an accumulator by means of a conduit with a non-return valve, which valve allows flow only from the cylinder of the second unit toward the accumulator, which accumulator has a conduit connection with a shut-off valve with the cylinders of a said first mentioned cylinder-piston unit through non-return valves which allow flow only from the accumulator toward said cylinders.

3. Coupling as claimed in claim 2, wherein the cylinders of the second units have a piston area which is smaller than the piston area of the said first units.

4. Coupling as claimed in claim 2, wherein the non-return valve in the conduit between the cylinders of the second units and the accumulator can be put out of operation.

5. Coupling as claimed in claim 1, wherein the struts are placed between the sleeve and the body supporting the sleeve at an acute angle to the axis of the sleeve.

* * * * *